US006010276A

United States Patent [19]

Young et al.

[11] Patent Number: 6,010,276

[45] Date of Patent: Jan. 4, 2000

[54] ISLAND FORM

[76] Inventors: James E. Young, 406 Inglenook Pl.; Roy A. Meyer, 1000 Crestview Dr., both of Angola, Ind. 46703

[21] Appl. No.: 08/889,950

[22] Filed: Jul. 10, 1997

Related U.S. Application Data

[63] Continuation-in-part of application No. 08/614,283, Mar. 12, 1996, Pat. No. 5,700,106.

[51] Int. Cl.[7] ..... E01C 11/22; E04B 1/16; E04G 17/00

[52] U.S. Cl. ..... 404/8; 404/7; 52/380; 249/219.1

[58] Field of Search ..... 404/8, 7; 52/380; 249/160, 168, 219.1

[56] References Cited

U.S. PATENT DOCUMENTS

| | | | |
|---|---|---|---|
| 1,697,765 | 1/1929 | Heltzel . | |
| 2,008,162 | 7/1935 | Waddell . | |
| 3,242,833 | 3/1966 | Sondheim | 404/8 |
| 3,242,834 | 3/1966 | Sondheim | 404/8 |
| 3,379,105 | 4/1968 | Lynch | 404/8 |
| 3,862,737 | 1/1975 | Fuston, Jr. . | |
| 3,938,776 | 2/1976 | Frasier . | |
| 4,202,145 | 5/1980 | Coulter et al. . | |
| 4,434,975 | 3/1984 | Tompkins | 256/17 |
| 4,712,764 | 12/1987 | White . | |
| 4,901,497 | 2/1990 | Lee . | |
| 4,986,042 | 1/1991 | Richardt | 52/102 |
| 5,044,601 | 9/1991 | Miller . | |
| 5,174,083 | 12/1992 | Mussell . | |
| 5,205,942 | 4/1993 | Fitzgerald . | |
| 5,265,836 | 11/1993 | Dale . | |

*Primary Examiner*—Thomas B. Will
*Assistant Examiner*—Gary S. Hartmann
*Attorney, Agent, or Firm*—Young & Basile, P.C.

[57] ABSTRACT

An easily assembled concrete form including a plurality of elongated wall members manufactured by roll forming and connected together to define an enclosure. Each wall member has a first end and a second end, an inner surface and an outer surface. Attached to the inner surface of the wall member at the first end is a key having legs extending beyond the first end of the wall member. Attached to the inner surface of the wall member at the second end is an interlocking bracket having two vertically spaced slots for receiving the legs of the key to connect adjacent wall members together. One of the slots is enlarged for also receiving an extending flange from a support bracket to frictionally maintain the U-shaped key and interlocking bracket in a locked relationship.

3 Claims, 4 Drawing Sheets

ISLAND FORM

This application is a Continuation-In-Part of application Ser. No. 08/614,283, filed on Mar. 12, 1996, U.S. Pat. No. 5,700,106.

FIELD OF THE INVENTION

The invention is a pouring form for the construction of concrete slabs and, especially for the construction of fuel islands that can be easily assembled at the site.

BACKGROUND OF THE INVENTION

Currently, a form for pouring a concrete structure is constructed by aligning a plurality of sheet metal members in an arrangement to define an enclosure. The adjacent sheet metal members are then connected and secured together by means of nuts and bolts at the site. During transport of the material and also at the construction site, a portion of the quantity of nuts and bolts can be lost or misplaced. This can result in loss labor time, while more material is acquired. Or as in some cases, the lost nuts and bolts are not replaced resulting in that the adjacent sheet metal members are not adequately secured together before the fluid concrete is poured. Even if all the connecting material is available, the assembly of such a concrete form is labor intensive and therefore costly because the labor to align the nuts and bolts and associated brackets during the assembly process can often exceed the cost of the material to construct the form.

SUMMARY OF THE INVENTION

Therefore, it is an object of the invention to provide interlocking elements incorporated into multi-paneled forms so that a minimum number of parts are necessary for the construction of the island form. It is further an object of the invention to provide connecting means so that the island form can be easily assembled at the site requiring a minimum amount of time. It is another object of the invention to provide reinforcing means that are easily connected into the connecting means. It is another object of this invention to manufacture the multi-paneled forms by a process that ensures uniformity of parts so that nuts and bolts are unnecessary for assembling the island form. It is another object of the present invention to provide a multi-paneled form for molding concrete that is lightweight and easily transportable. As a result, a criteria of this invention is to provide precisely made multi-panel forms having integral connecting means to minimize labor at the assembly site and to prevent material loss during transportation and at the site.

The aforementioned objects of the invention are realized by a plurality of wall forms or wall members wherein each wall member has a first end and a second end such that a first end of one wall member is connected to a second end of an adjacent wall member thereby defining an enclosure for receiving and retaining fluid concrete poured therein. On the first end of each wall member is a key for connection into interlocking slots located at the second end of each wall. The key has two or more extending legs that slidably engage within the interlocking slots of an adjacent wall member for connection thereto. The legs of the key extends beyond the first end of each wall such that when the key is inserted into the slot, the ends of adjacent walls abut to each other.

The walls may include shelves extending on the inner surface of each wall member. Brace members may then extend laterally across from one wall portion to an opposing wall member and latch onto the shelves of the corresponding walls. The brace members provide further rigidity for the concrete form mold prior to pouring of the fluid concrete therein.

The brace members and the aforementioned two or three prong key and locking slots may be incorporated together such that the brace member provides a further locking means for securing adjacent wall members. One or more of the interlocking slots for receiving one or more of the legs of the key may be sized slightly larger than the slot for the other leg of the key. The larger slot will then accommodate the corresponding leg of the U-shaped key as well as a horizontally extending flange of the brace member. When the flange of the brace member is positioned adjacent the leg of the key into the interlocking slot, the flange frictionally locks the U-shaped key in place and thereby maintains adjacent wall members in abutting and connecting formation.

The aforementioned parts for the island form are manufactured by the roll forming process so that similar parts are uniform; and all the parts are precisely made so that the connecting means of adjacent wall members fit together precisely. This process further has the advantage of being less expensive than using a press to form the parts as is currently done. Roll forming further allows the manufacturer to use coiled steel material for the process.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
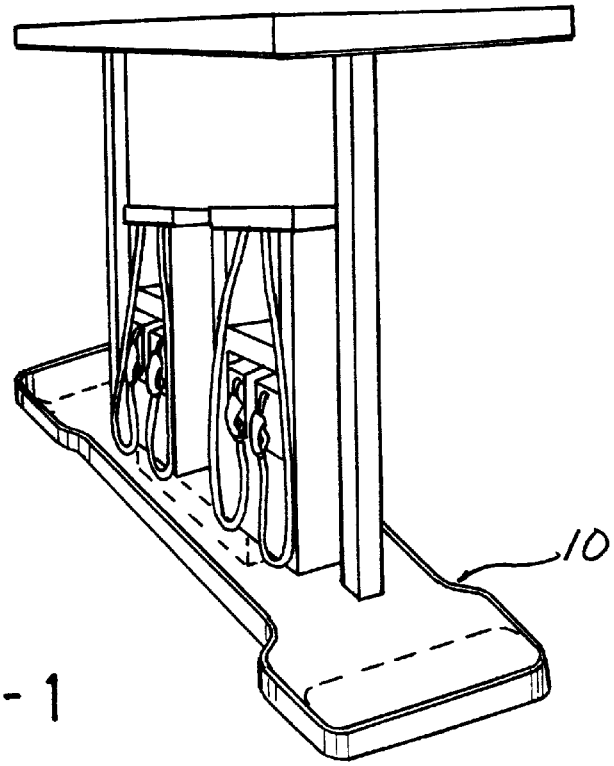
FIG. 1 is a perspective view showing the pouring form in use as a fuel island.

FIG. 1 shows the concrete slab pouring form 10 of the current invention in use as a fuel or gasoline island. Although this invention is shown in use for a fuel island, it is conceivable that the concrete slab pouring form 10 of the present invention as described hereinafter may be used for other utilities such as patios, driveways, curbing and the like.

Figure 2:
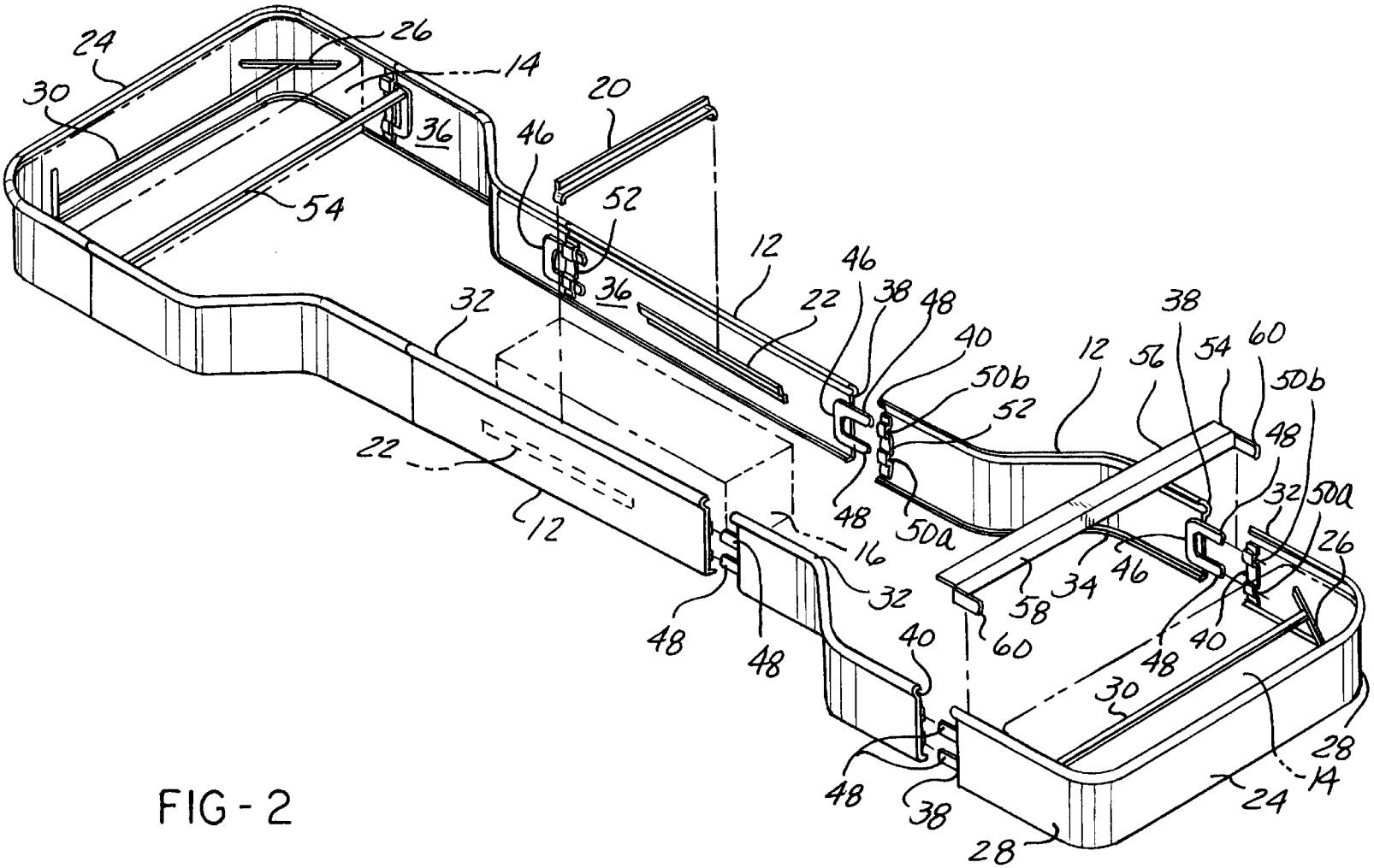
FIG. 2 is an exploded view of the pouring form of the present invention showing wall members, key members, interlocking slots and brace members.
Figure 3:
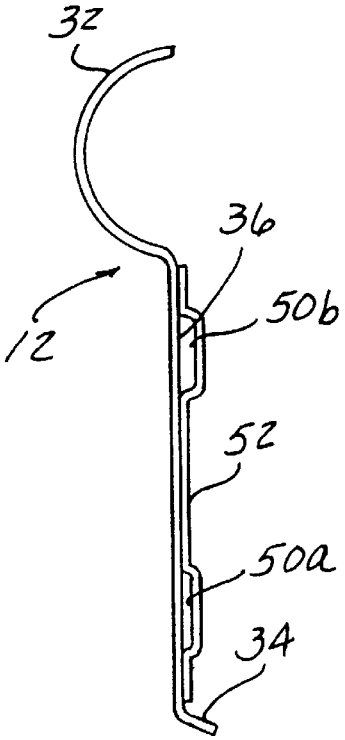
FIG. 3 is an end view of a wall member showing the interlocking slots.
Figure 4:
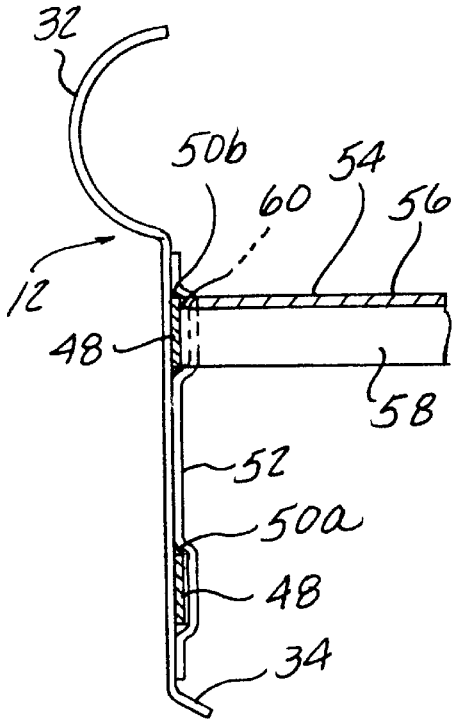
FIG. 4 is an end view of the wall member of FIG. 3 showing the key member and brace member inserted therein.

FIGS. 2 through 4 show the first embodiment of the invention constructed as a fuel island. Looking first at FIG. 2, the concrete slab pouring form 10 comprises a plurality of elongated wall members 12 shaped such that when connected together in adjacent formation, the wall members 12 define an enclosure for receiving and retaining fluid concrete poured therein. As seen in FIG. 2 the wall members 12 may be straight or curved so that the fuel island is configured in a dog-bone configuration to accommodate bumper insets 14 at each end of the island 10 and a fuel transmission inset 16 relatively centrally located within the island form 10. Other configurations are also conceivable such as barbell, bowtie, oval, rectangular, square and round styles.

The concrete slab pouring form 10 includes the plurality of wall members 12 having connecting means at each end of each wall member 12 to securely connect adjacent wall members 12 together without the need of tools or other external equipment. The pouring form 10 further includes lateral supporting means having brace members 20 and locking shelves 22. End portions of the island form may have separate wall members configured as rounded wall end members 24 having integral support members 26 diagonally traversing each corner 28 of the rounded wall end member 24 and a second support member 30 connecting the corresponding diagonal corner support members 26. Each wall member whether it is for use along the side or a rounded wall end member 24 has an inwardly facing curled flange 32 at its upper edge so that the concrete as it flows into the form will be maintained underneath the curled flange 32 within the form 10. The wall member 12 may further include a lower lip 34 at the distal end of the curled flange 32 which is placed in contact with the ground. Located on an inner surface 36 of the wall member 12 and spaced from the ends 38, 40 is a locking shelf 22. The locking shelf 22 is mounted by the manufacturer at a predetermined height on appropriate wall members 12 for receiving and maintaining the supporting brace member 20 in an essentially parallel manner when brace member 20 traverses the island form 10. The locking shelf 22 as can be seen more clearly in FIG. 5 has an upturned ridge 42 for receiving a downturned flange 44 on the brace member 20. The supporting brace member 20 is a bracket that extends from one wall member 12 to an opposing wall member 12 to help maintain the appropriate wall members 12 in a standing upright position before and while the concrete is poured therein and to provide stability for the entire pouring form 10. Each support brace member 20 has downturned extending flanges 44 at each end of the brace member 20 for placement in the ridge 42 of the shelf 22. The shelf 22 on each appropriate wall member 12 has a predetermined length so that the support brace member 20 may be placed along any portion of the length of the shelf 22.

Each wall member 12 has two ends 38, 40 for connecting to an adjacent wall member 12. Connecting means are located at an end of the wall members. At a first end 38 of each wall member 12 the connecting means includes an essentially U-shaped key 46 having vertically spaced legs 48 extending beyond the first end 38 of the wall member 12. The second end 40 of each wall member 12 has interlocking slots 50*a* and 50*b* to receive and secure the U-shaped key 46 attached at the end of one wall member 12 against the internal surface of an adjacent wall member. The U-shaped key 46 and its vertically extending legs 48 provide more strength along the height of the wall than a single extending leg configuration.

The interlocking slots 50*a*, 50*b* of the first embodiment are formed by a locking bracket 52 and is shown more clearly in FIG. 3. The interlocking bracket 52 is configured to form a pair of vertically spaced slots 50*a*, 50*b* for receiving the vertically spaced legs 48 of the U-shaped key 46 therein. Preferably, one of the slots 50*a* is sized to tightly accommodate one of the legs 48 of the U-shaped key 46 allowing little or no movement of the leg therein. The other slot 50*b* is made slightly larger by extending the bracket 52 away from the inner wall surface 36 to define a larger slot 50*b*, for reasons explained hereinafter.

A combination support brace and wall interlocking means is shown at 54 in FIGS. 2 and 4. The combination support brace and interlocking means 54 is configured as an elongated member similar to brace member 20. Combination brace and interlocking means (combination bracket) 54 has a horizontal surface 56 and a vertical surface 58 extending the length of the combination bracket 54 for added rigidity. The combination bracket 54 extends to inner wall connecting means of opposing walls 12. At each end of the combination bracket 54 and extending perpendicularly from the vertical surface 58 are horizontally extending flanges 60 sized and shaped to accommodate and fit with little clearance in larger slot of the interlocking means. Therefore, as seen in FIG. 4, the interlocking means in the large slot 50*b* will tightly accommodate both the one leg 48 of the U-shaped key 46 adjacent the inner surface 36 of the wall member 12 and the flange 60 of the combination bracket 54 placed adjacent to the leg 48 of the U-shaped key 46. This configuration provides the advantages of eliminating separate shelves 22 and support brace members 20 located in a central location on the interior wall 36 of the wall member if desired. It further provides an additional advantage of securely locking the U-shaped key 46 within the interlocking slots 50*a*, 50*b* and frictionally maintaining them in place. The U-shaped key 46 and interlocking bracket 52 between wall members is further advantageous in that it provides vertical support at the ends of the wall members 12 to prevent twisting and deformation of the wall member 12.

Figure 5:
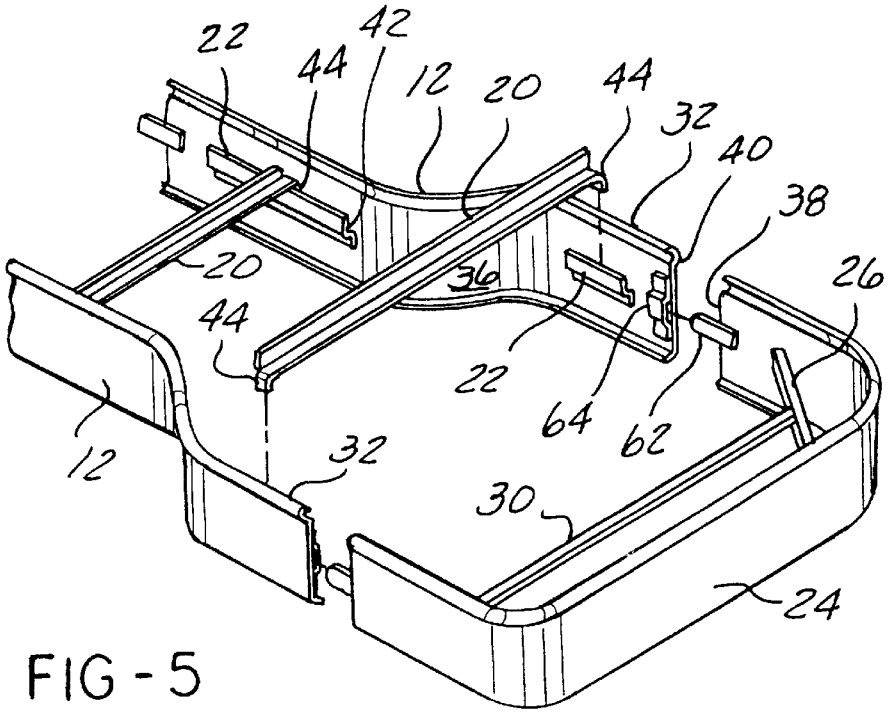
FIG. 5 is a perspective view of a second embodiment of the present invention.

An alternative embodiment replaces the U-shaped key 46 with a single leg member 62 for insertion into a single slot interlocking means 64. The interlocking slot 66 as shown in FIG. 5 may be sized simply to accommodate the single leg key 46 at the adjacent wall end 38. As an alternative the single slot 66 may be enlarged to accommodate both the single leg key 62 and a horizontal flange 60 of a combination bracket 54 as described in FIG. 4 for locking the key 62 and interlocking means 64 more securely.

Figure 8:
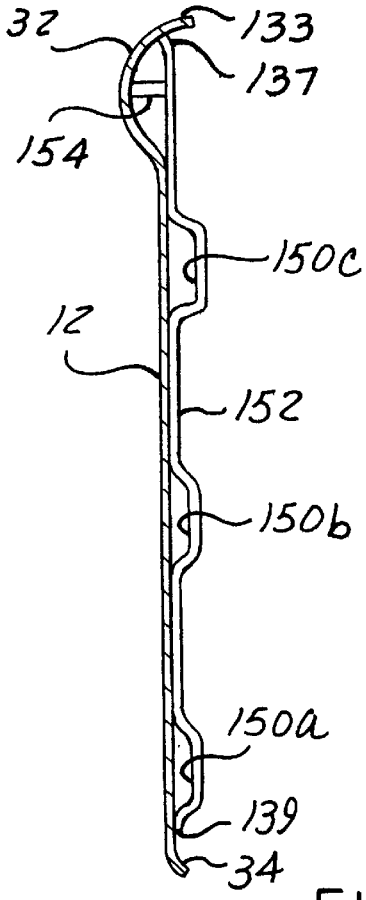
FIG. 8 is a is an end view of a wall member showing the interlocking slots of a third embodiment.
Figure 9:
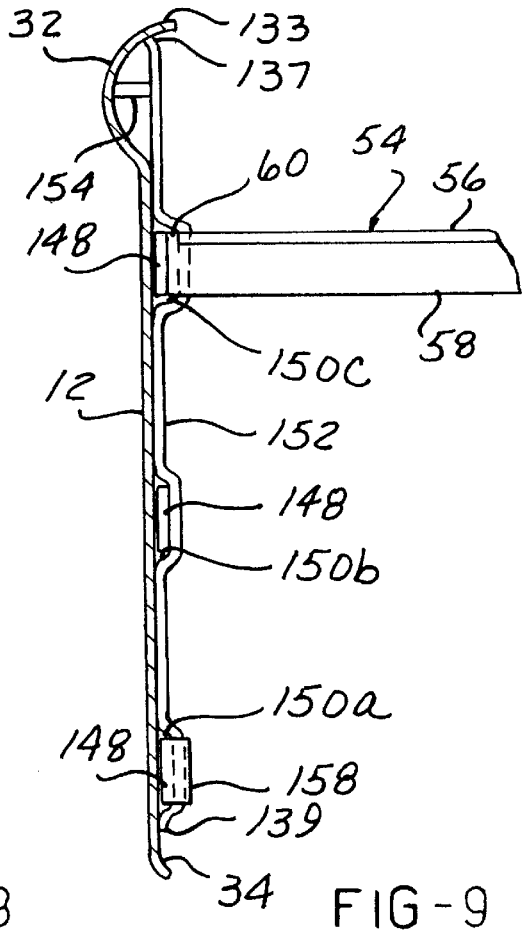
FIG. 9 is an end view of the wall member of FIG. 8 showing a corresponding key member of the third embodiment and brace member inserted therein.
Figure 7:
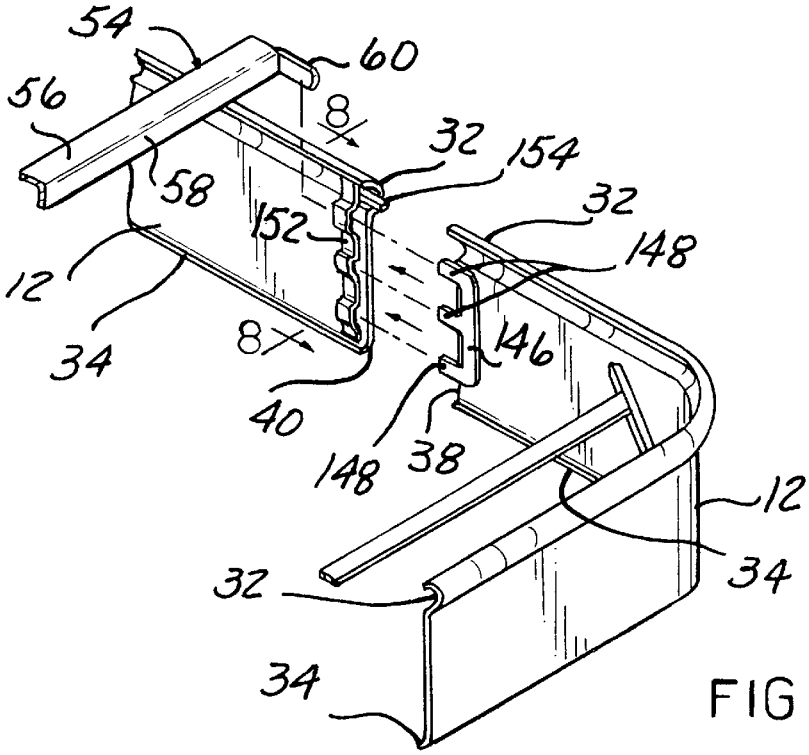
FIG. 7 is a perspective view of a third embodiment of the present invention.

A third alternative embodiment is shown in FIGS. 7 through 9. Similar elements to the previous embodiments are numbered the same. Looking at FIG. 7, again each wall member 12 has two ends 38, 40 for connecting to an adjacent wall member 12. The connecting means are located at an end of the wall members. At a first end 38 of each wall member 12 the connecting means includes a key 146 having vertically spaced legs 148 extending beyond the first end 38 of the wall member 12. Although any number of legs 148 may extend from the key 146, it is preferable to have two or three legs for stability of the wall member 12. FIGS. 7–9 show three legs 148. The second end 40 of each wall member 12 has a bracket 152 with corresponding interlocking slots 150*a*, 150*b*, and 150*c* formed against wall member 12 to receive and secure the key 146 attached at the first end 38 of one wall member 12 against the internal surface of an adjacent wall member 12. The key 146 and its vertically spaced legs 148 provide more strength along the height of the wall then a single extending leg configuration. One of the slots 150*c* may be made slightly larger to accommodate the combination bracket 54 as will be discussed further.

The interlocking slots 150*a*, 150*b*, and 150*c* are formed by the locking bracket 152 secured against the internal surface of wall member 12 and is shown more clearly in FIGS. 8 and 9. The interlocking bracket 152 is configured to extend the entire height of the wall member 12. The interlocking bracket 152 has a first end 137 that extends to the top end 133 of the curled flange 32; and has a second end 139 that extends just short of the angled lower lip 34 of wall 12. The interlocking bracket 152 is spot welded to the wall 12 along its length and is further welded at the end 133 of the curled flange 32. The first end 137 of the interlocking bracket 152 may be press broken 45 degrees toward flange 32 to provide adequate surface area for welding.

To provide further stability at the curled flange 32, a metal flat stock 154 of approximately ⅜" wide by ¾" thick is aligned and welded within the curled flange 32 so that a portion of the interlocking bracket 152 rests on a surface of the flat stock 154. The flat stock 154 extends beyond the vertical wall edge 40 so that when an adjacent wall member is abutted to the first wall member the flat stock 154 will then support the adjacent curled flange 32 of the first and second ends 38 and 40 respectively, of wall member 12. If desired a similar combination brace and interlocking means (combination bracket) 54 as discussed infra and shown in FIGS. 2 and 4 can be sized and shaped to accommodate and fit into the clearance of the larger slot 150*c* of the interlocking bracket 152. The extending flanges 60 of the combination bracket 54 fit with little clearance in larger slot 150*c*. Therefore, as seen in FIG. 9, the larger slot 150*c* will tightly accommodate both one leg 148 of key 146 adjacent the inner surface of the wall member 12 and flange 60.

Once the entire island form is assembled and ready for final installation, the end tips 158 of each leg 148 can be bent to prevent the legs 148 of key 146 from sliding out of slots 150*a*–150*c* and permanently lock the island form in place before concrete is poured therein. A bent tip 158 is shown in FIG. 9 through interlocking slot 150*a*.

A key to the island form is the method of manufacturing the individual parts so that they are precisely made to ensure uniformity. The wall members 12 and other parts of the island form are manufactured from coiled steel by the roll forming process to produce uniform forms that precisely fit together. Roll forming is a rapid method of forming long lengths of structural shapes by a continuous bending operation through a series of rolls. The precision of the resultant wall members 12 and integral connecting means results in adjacent wall members uniformly fitting together to avoid alternative connecting means such as nuts and bolts as is necessary in the prior art.

Figure 6:
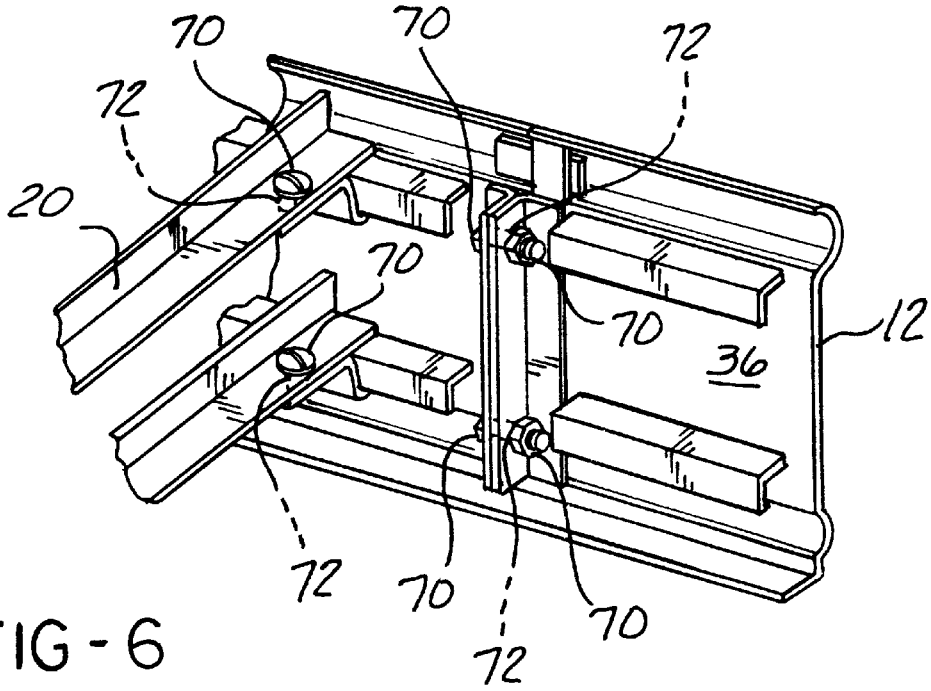
FIG - 6 PRIOR ART
FIG. 6 is a fragmentary perspective view of a connector of adjacent wall members using the prior art.

FIG. 6 shows a representative of the current and prior art for building concrete forms. As can be seen in FIG. 6, the assemblage of this form includes a plurality of nuts and bolts 70 that must be aligned and placed through apertures 72 for connecting adjacent wall members 12. Generally during transport or at the assembly site, some of these nuts and bolts 70 are lost or misplaced resulting in either lost labor time, lost material, or ineffective construction that does not provide a sturdy, concrete form that will not buckle or twist as disclosed by the subject invention.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A form for receiving liquid concrete therein comprising:

a plurality of elongated wall members each wall member having first and second ends and an inner surface wherein the elongated wall members are contiguously positioned in end to end alignment to form an enclosure, wherein a first end of one elongated wall member is adjacent a second end of an adjacent wall member; wherein each elongated wall member includes a top portion curved inwardly for retaining the liquid concrete; and means for connecting adjacent wall members wherein the connecting means includes a key attached to the inner surface of the wall proximate to the first end and extending beyond the first end of the wall and an interlocking bracket attached to the inner surface at the second end for receiving said key, wherein said interlocking bracket has a first end that extends to the curved top portion and wherein a single piece of flat stock is welded to an inner surface of the inwardly curved top portion at the second end of the wall member, disposed between the inwardly curved top portion and the interlocking bracket and extending beyond the second end of the wall member.

2. The form of claim 1, wherein a portion of the interlocking bracket contacts the piece of flat stock.

3. A form for receiving liquid concrete therein comprising:

a plurality of elongated wall members each wall member having first and second ends and an inner surface wherein the elongated wall members are contiguously positioned in end to end alignment to form an enclosure, wherein a first end of one elongated wall member is adjacent a second end of an adjacent wall member; wherein each elongated wall member includes a top portion curved inwardly for retaining the liquid concrete; and single means for connecting and locking adjacent wall members wherein the single connecting and locking means includes a key attached to the inner surface of the wall proximate to the first end and extending beyond the first end and an interlocking bracket attached to the inner surface at the second end for receiving said key, wherein said interlocking bracket has a first end that extends to the curved top portion wherein the key has extending legs and the interlocking bracket forms corresponding slots having a predetermined width for individually receiving an extending leg, said legs having a length longer than the width of the corresponding slots, and said legs bendable over the slots to define the locking means.

* * * * *